US006955560B1

(12) United States Patent
Biggs

(10) Patent No.: US 6,955,560 B1
(45) Date of Patent: Oct. 18, 2005

(54) ADAPTER SYSTEM FOR CONNECTING COAXIAL CABLE TO TELEPHONE CABLE

(76) Inventor: Andy J. Biggs, 51 Via Villario, Rancho Santa Margari, CA (US) 92688

( * ) Notice: Subject to any disclaimer, the term of this patent is extended or adjusted under 35 U.S.C. 154(b) by 0 days.

(21) Appl. No.: 10/887,831

(22) Filed: Jul. 12, 2004

(51) Int. Cl.[7] ..... H01R 13/74
(52) U.S. Cl. ..... 439/536; 439/654
(58) Field of Search ..... 439/536, 581, 439/676, 502, 654, 638

(56) References Cited

U.S. PATENT DOCUMENTS

| | | | | |
|---|---|---|---|---|
| 4,362,905 A | | 12/1982 | Ismail | |
| 4,648,682 A | | 3/1987 | Tubbs | 439/391 |
| 4,740,172 A | | 4/1988 | Tubbs | 439/344 |
| 5,013,260 A | * | 5/1991 | Caveney et al. | 439/536 |
| 5,064,386 A | | 11/1991 | Dale et al. | |
| 5,114,365 A | * | 5/1992 | Thompson et al. | 439/540.1 |
| 5,240,436 A | | 8/1993 | Bradley et al. | 439/654 |
| 5,326,931 A | | 7/1994 | Cain et al. | |
| 5,413,494 A | | 5/1995 | Dewey et al. | |
| 5,454,734 A | | 10/1995 | Eggert et al. | |
| 5,896,556 A | | 4/1999 | Moreland et al. | 725/106 |
| 5,968,118 A | | 10/1999 | Sutton, Jr. | 725/78 |
| 6,069,315 A | | 5/2000 | Tang | |
| 6,290,538 B1 | * | 9/2001 | Pocrass | 439/676 |
| 6,433,672 B1 | * | 8/2002 | Shirmard | 439/502 |
| D463,969 S | * | 10/2002 | Luu | D8/353 |
| 6,488,542 B2 | | 12/2002 | Laity | |
| 2001/0000161 A1 | | 4/2001 | Laity | |
| 2001/0053627 A1 | | 12/2001 | Armistead et al. | |

FOREIGN PATENT DOCUMENTS

| | | |
|---|---|---|
| CA | 2268686 | 10/2000 |

* cited by examiner

*Primary Examiner*—Briggitte R. Hammond
(74) *Attorney, Agent, or Firm*—Richard C. Litman

(57) ABSTRACT

The adapter system allows for electrical communication between a coaxial cable and a telephone cable or telephone line cord. The adapter system includes a wall-mounting adapter connected by a coaxial cable to a block adapter. The wall-mounting adapter includes a telephone jack and a coaxial cable connector. The wall-mounting adapter allows for electrical communication from the coaxial cable to a telephone through a cord inserted within the telephone jack. The block adapter includes a coaxial cable connector, a telephone jack and a telephone cable. The block adapter electrically connects the coaxial cable to the telephone cable or a telephone cord inserted within the telephone jack.

4 Claims, 6 Drawing Sheets

ADAPTER SYSTEM FOR CONNECTING COAXIAL CABLE TO TELEPHONE CABLE

BACKGROUND OF THE INVENTION

1. Field of the Invention

The present invention relates to electrical connectors, and particularly to an adapter system for connecting coaxial cable to telephone cable.

2. Description of the Related Art

Coaxial cable wall plates are commonly situated on walls in homes and apartments to allow for coaxial cable connection. Coaxial cable is capable of transmitting both audio and video signals and is the primary cabling used by cable television companies and local area networks. While helpful in setting up cable television or computer networks, many individuals would prefer that the coaxial wall plate was instead a telephone jack wall plate.

Telephones are required to connect into specific wallplates having telephone jacks for reception of a telephone cable plug. There are a limited number of telephone jacks throughout an individual's home, thus requiring the individual to only place telephones near the telephone jacks. This restriction of position may not be preferential to the individual, who may prefer a different placement for the telephones. Thus, it would be useful to provide an adapter system that converts coaxial cable to be used for telephone cable.

The related art endeavors to provide adapters that modify existing electrical connectors. However, they do not easily allow for coaxial cable to be adapted to allow for telephone use.

U.S. Pat. No. 4,648,682, issued Mar. 10, 1987 to J. Tubbs, describes a pair of modular adapters for connecting VCR output terminals to television or other video equipment terminals. Each adapter has a housing with a modular jack portion and a coaxial connector or a twin-lead cable portion. The modular jack conductors are connected to the coaxial connector conductor or the twin-lead cable wires. The adapters are connected to one another with a modular connector cable. The cable has telephone jacks on either end, and each jack is inserted within each modular jack portion.

U.S. Pat. No. 4,740,172, issued Apr. 26, 1988 to J. Tubbs, describes a modular adapter for connecting VCR output terminals to television or other video equipment terminals. The adapter has a housing with a modular jack portion and a coaxial connector or a twin-lead cable portion. In another embodiment, the adapter may include screw terminals and a switch that allows for selection of the screw terminals or the coaxial connector.

U.S. Pat. No. 5,240,436, issued Aug. 31, 1993 to J. Bradley et al., describes an electrical connector having an RJ jack housing at one connector end for connection to a telephone jack and another connector end for connection to a coax cable. Internal circuitry within the electrical connector housing connects the coax cable connector end to the RJ jack housing connector end.

Other patents showing electrical connectors include U.S. Pat. Pub. No. U.S. 2001/0000161 A1, published Apr. 5, 2001 and invented by I. Laity (type III PCMCIA card with integrated receptacles for receiving standard communications plugs); U.S. Pat. Pub. No. U.S. 2001/0053627 A1, published Dec. 20, 2001 and invented by R. Armistead et al. (single-port connection and circuitry accepting both balanced and unbalanced data signals); U.S. Pat. No. 4,362,905, issued Dec. 7, 1982 to N. Ismail (universal adapters for modular plug telephones); U.S. Pat. No. 5,064,386, issued Nov. 12, 1991 to J. Dale et al. (convenience electrical outlet assembly); U.S. Pat. No. 5,326,931, issued Jul. 5, 1994 to S. Cain et al. (cable distribution interface unit); U.S. Pat. No. 5,413,494, issued May 9, 1995 to J. Dewey et al. (jack module assembly); U.S. Pat. No. 5,454,734, issued Oct. 3, 1995 to U. Eggert et al. (electrical connection system).

U.S. Pat. No. 5,896,556, issued Apr. 20, 1999 to L. Moreland et al. (apparatus and method for providing a telephone connection over a coax cable distribution system); U.S. Pat. No. 5,968,118, issued Oct. 19, 1999 to G. Sutton, Jr. (information outlet and industrial set top functionality); U.S. Pat. No. 6,069,315, issued May 30, 2000 to D. Tang (cable clamping apparatus for junction box); U.S. Pat. No. 6,488,542 B2, issued Dec. 3, 2002 to I. Laity (type III PCMCIA card with integrated receptacles for receiving standard communications plugs); Can. Pat. No. 2,268,686, published Oct. 14, 2000 (apparatus and method for providing a telephone connection over a coax cable distribution system); website http://phoneus.ronniebou.net/phone/phonejack.html.

Although the related art addresses electrical adapters, what is needed is an adapter or adapter system that is capable of converting an existing coaxial cable for use as a telephone cable.

None of the above inventions and patents, taken either singly or in combination, is seen to describe the instant invention as claimed. Thus an adapter solving the aforementioned problems is desired.

SUMMARY OF THE INVENTION

The invention is an adapter system that allows for electrical communication between a coaxial cable and a telephone cable or telephone line cord. The adapter system includes a wall-mounting adapter connected by a coaxial cable to a block adapter. The wall-mounting adapter replaces a typical coax wallplate and has a wallplate, which is adapted to mount the wall-mounting adapter flush against a wall, a modular telephone jack, and a coaxial cable connector. A first and a second conductive wire are mounted within the telephone jack and electrically connected to the frame. The coaxial cable connector attaches to the coaxial cable. A telephone line cord is insertable within the modular telephone jack and is capable of being plugged into a telephone.

The block adapter additionally has a coaxial cable connector to which the coaxial cable is attached and a telephone jack. The block adapter electrically connects the coaxial cable to a second telephone line cord or to a multi-wired telephone cable. The second telephone line cord is inserted within the modular telephone jack of the block adapter. The second telephone line cord or the multi-wired telephone cable are electrically connected to the telephone company's lines in such a manner as to provide for conventional data transmission to and from a telephone.

Terminals are disposed on the block adapter. The telephone jack within the block adapter has a number of conductors mounted within it. These conductors are connected to the terminals. The coaxial cable connector within the block adapter has a center conductor that is connected to a terminal and a frame that is electrically connected to another terminal. Thus, the coaxial cable, which is attached to the coaxial cable connector, is able to electrically communicate through the telephone jack in the block adapter. The multi-wired telephone cable of the block adapter has conductors connected to the terminals. Thus, the coaxial cable is additionally able to electrically communicate through the telephone cable.

In a second embodiment, the wall-mounting adapter is omitted and a coaxial cable connects a second block adapter to a first block adapter. The second block adapter attaches to an already-existing coax wall jack either by a second coaxial cable or directly to the coax wall jack. The second block adapter omits the telephone cable. A telephone line cord is insertable within the modular telephone jack of the second block adapter and connected to a telephone for an individual's use.

It is an aspect of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
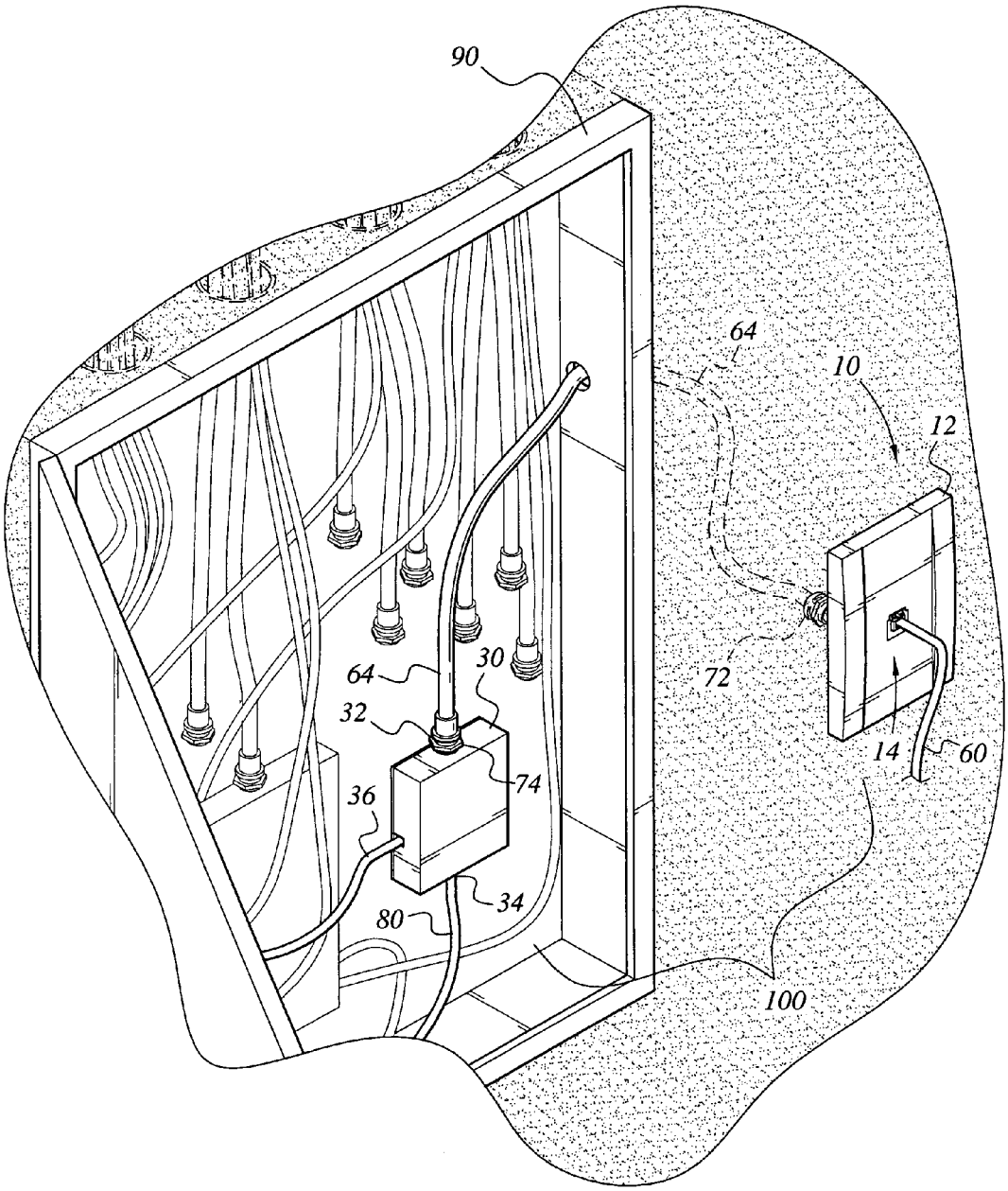
FIG. 1 is an environmental, perspective view of an adapter system according to a first embodiment of the present invention.

The present invention is an adapter system, designed generally as 100 in the drawings. The adapter system 100 includes a wall-mounting adapter 10 connected by a coaxial cable 64 to a block adapter 30. The adapter system 100 allows for electrical communication between the coaxial cable 64 and a first telephone line cord 60 for use with a telephone.

Referring first to FIG. 1, the wall-mounting adapter 10 replaces a typical coax wall jack. The wall-mounting adapter 10 includes a wallplate 12, which is adapted to mount the wall-mounting adapter 10 flush against the wall, a first modular telephone jack 14, and a first coaxial cable connector 16. The first coaxial cable connector 16 attaches to the coaxial cable 64. A first telephone line cord 60 is insertable within the first modular telephone jack 14 of the wall-mounting adapter 10, the first telephone line cord 60 capable of being plugged into a telephone.

The coaxial cable 64, typically run through a wall, is connected to the wall-mounting adapter 10 and the block adapter 30. The coaxial cable 64 has a first end 72 and a second end 74. The first end 72 of the coaxial cable 64 is connected to the wall-mounting adapter 10. The second end 74 of the coaxial cable 64 is attached to the block adapter 30 that is situated within a terminal box 90. The coaxial cable 64 thereby allows for electrical communication between the wall-mounting adapter 10 and the block adapter 30.

The block adapter 30 has a second coaxial cable connector 32 to which the coaxial cable 64 is attached. The block adapter 30 electrically connects the coaxial cable 64 to a second telephone line cord 80 and/or to a multi-wired telephone cable 36. The second telephone line cord 80 is inserted within a second modular telephone jack 34 integrally connected to the block adapter 30. The second telephone line cord 80 and/or the multi-wired telephone cable 36 are electrically connected to the telephone company's lines in such a manner as to provide for conventional data transmission to and from a telephone.

Figure 2:
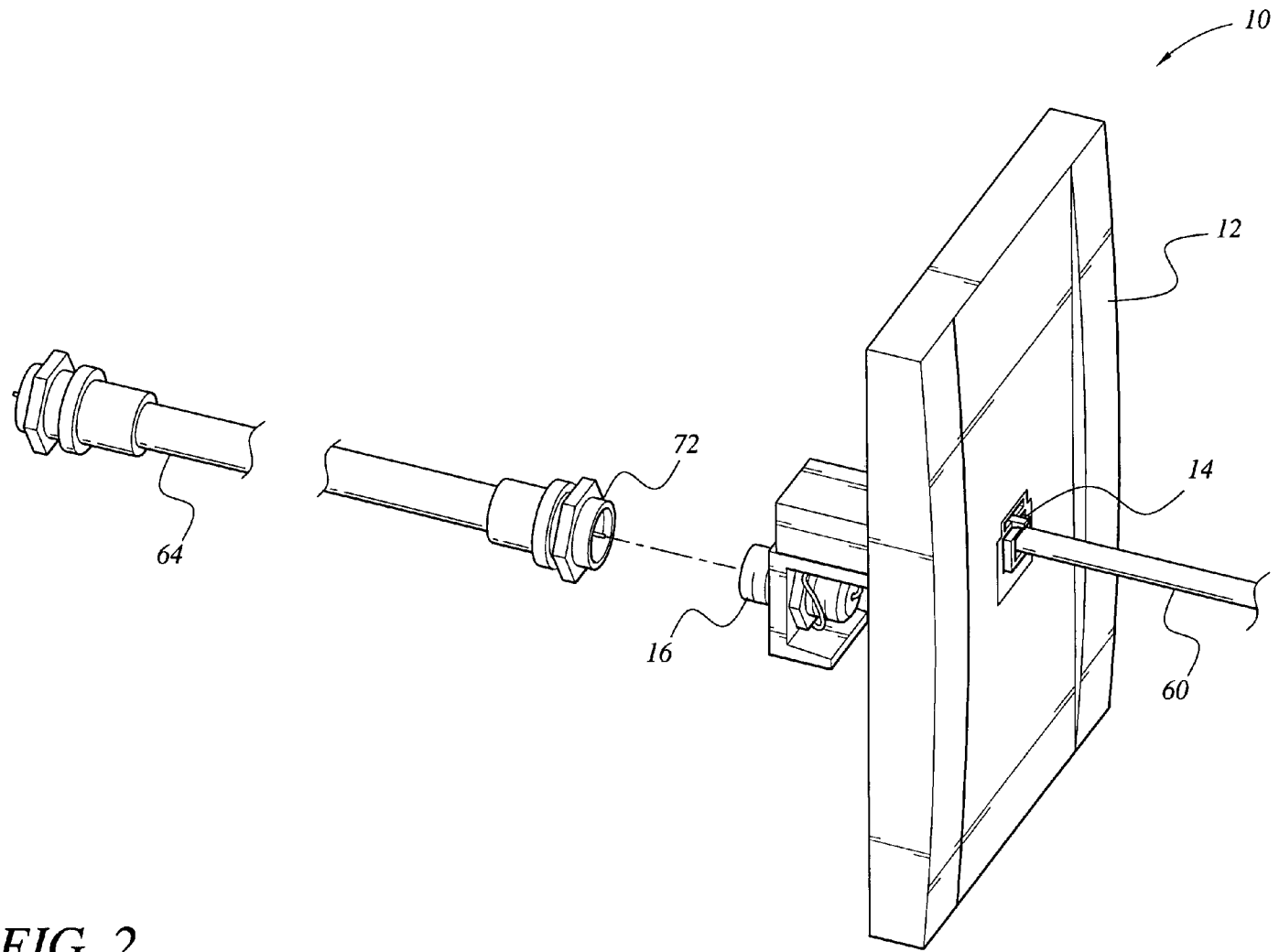
FIG. 2 is a perspective view of a first adapter of the adapter system according to the first embodiment of the present invention.

Turning to FIG. 2, the wall-mounting adapter 10 is shown with the coaxial cable 64. The wall-mounting adapter 10 includes the wallplate 12, the first modular telephone jack 14 attached to the wallplate 12, and the first coaxial cable connector 16 attached to the wallplate. The first coaxial cable connector 16 connects to the coaxial cable 64. The first telephone line cord 60 is inserted into the telephone jack 14 and is connected to a telephone for use by an individual. The wall-mounting adapter 10 replaces a typical coax wall jack and is mounted flush against the wall.

Figure 3:
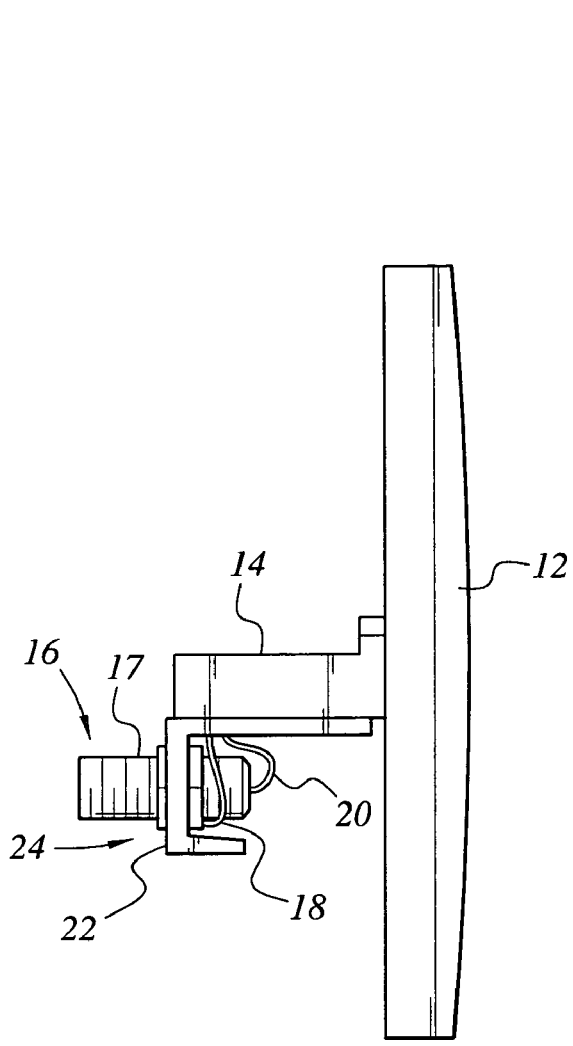
FIG. 3 is an elevational side view of the first adapter of the adapter system according to the first embodiment of the present invention.

FIG. 3 shows a side view of the wall-mounting adapter 10. The wall-mounting adapter 10 includes the wallplate 12, the first modular telephone jack 14, and the first coaxial cable connector 16. The first modular telephone jack 14 is attached to the wallplate 12. A mounting bracket 22 is affixed to the first telephone jack 14. The mounting bracket 22 has an aperture 24 defined therein. The first coaxial cable connector 16 having a first frame 17 is supported within the aperture 24 and is capable of attaching to the coaxial cable 64. A first conductive wire 18 is mounted within the first telephone jack 14 and is electrically connected to the frame 17 of the first coaxial cable connector 16. A second conductive wire 20 is mounted within the telephone jack 14 and is electrically connected to the frame 17 of the first coaxial cable connector 16.

Figure 4:
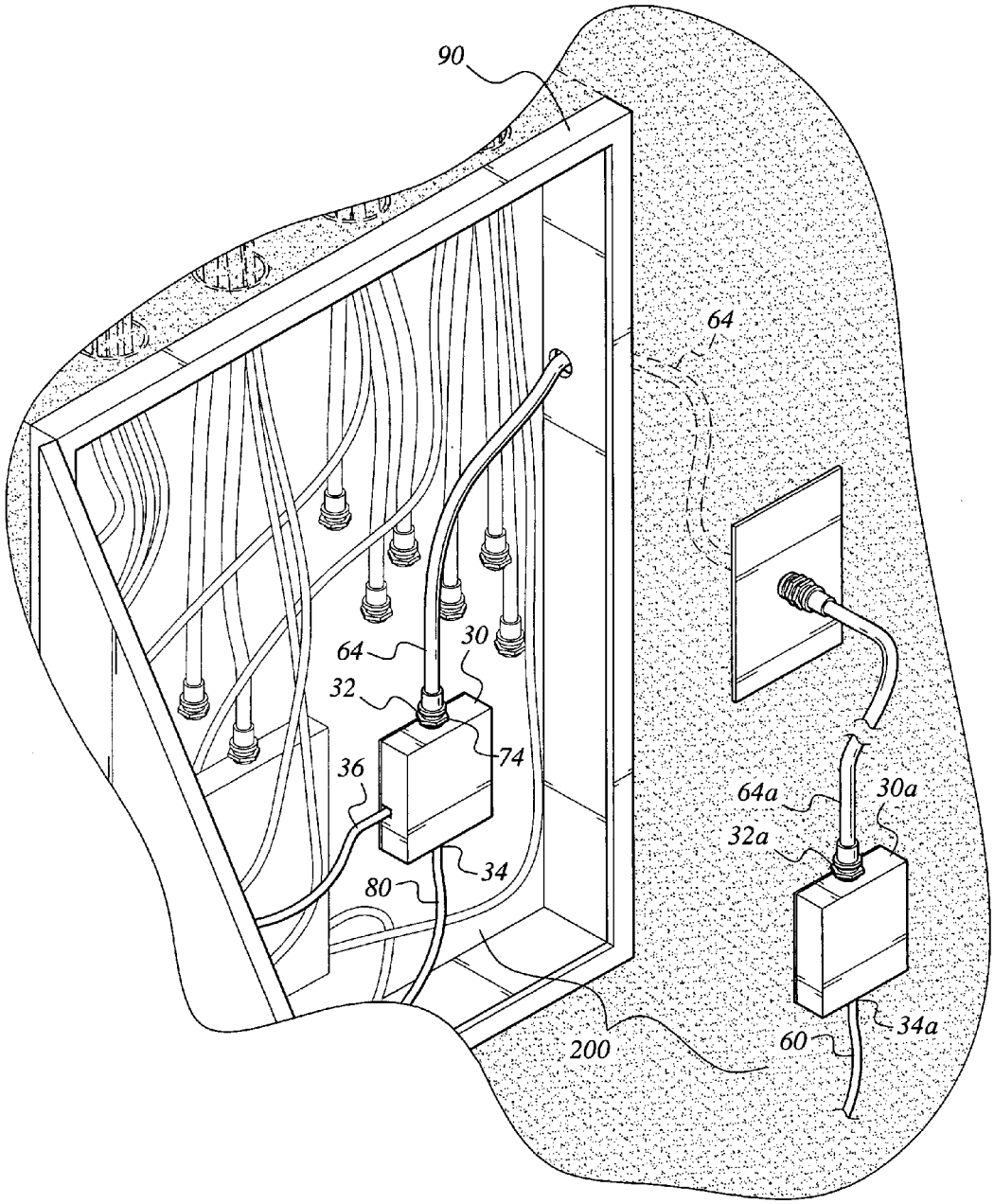
FIG. 4 is an environmental, perspective view of an adapter system according to a second embodiment of the present invention.

FIG. 4 shows an alternate adapter system 200. A second block adapter 30*a* attaches to an already-existing coax wall jack 70 either by a second coaxial cable 64*a* or directly to the coax wall jack 70. The second block adapter 30*a* omits the multi-wired telephone cable 36. The first telephone line cord 60 is insertable within the modular telephone jack 34*a* of the second block adapter 30*a*. The first coaxial cable 64 attaches to the coax wall jack 70 at the first end 72 of the cable 64 and the first block adapter 30 at the second end 74 of the cable 64.

Figure 5:
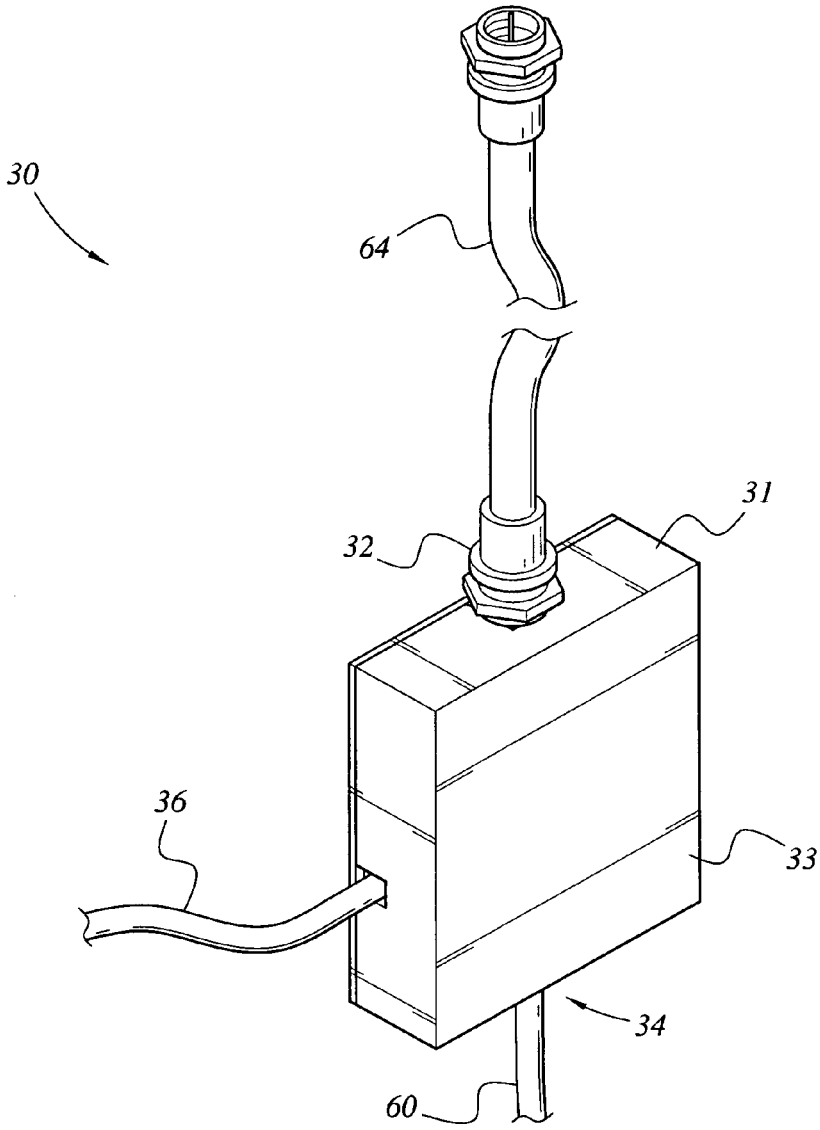
FIG. 5 is a perspective view of a second adapter of the adapter system according to the first embodiment of the present invention.
Figure 6:
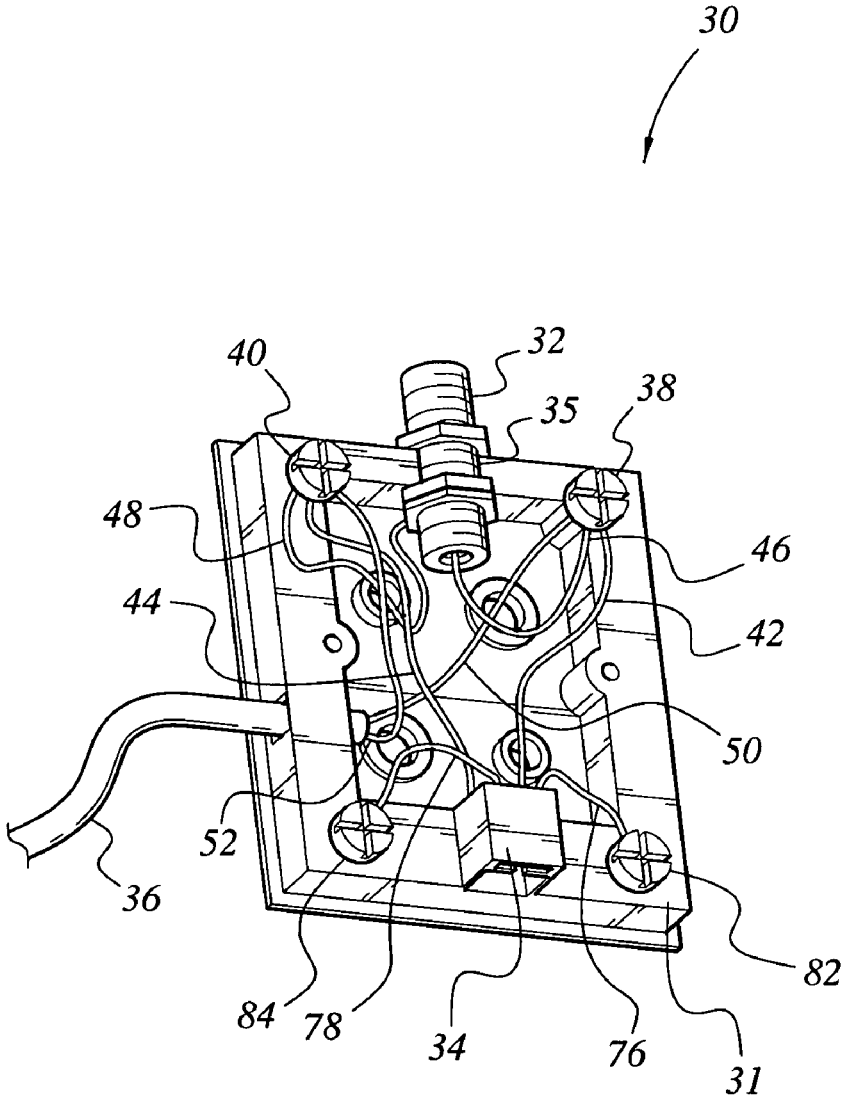
FIG. 6 is a perspective top view of the inside of the second adapter according to the first embodiment of the present invention.

FIGS. 5 and 6 show the block adapter 30. The block adapter 30 is a block 31 having a cover 33. The block adapter 30 has a first 38, a second 40, a third 82 and a fourth terminal 84 disposed on the block 31. The block adapter 30 includes a second modular telephone jack 34 integrally connected to the block 31, and a second coaxial cable connector 32 attached to the block 31. The second modular telephone jack 34 has a first 42, a second 44, a third 76 and a fourth 78 conductor mounted within the jack 34. The first conductor 42 is connected to the first terminal 38 and the second conductor 44 is connected to the second terminal 40. The third conductor 76 and the fourth conductor 78 are connected to the third terminal 82 and the fourth terminal 84, respectively.

The second coaxial cable connector 32 has a center conductor 46 that is connected to the first terminal 38 and a frame 35 that is electrically connected to the second terminal 40 by a first contact wire 48. Thus, the first conductor 42 and the center conductor 46 allow for the coaxial cable 64, which is attached to the second coaxial cable connector 32, to electrically communicate through the second modular telephone jack 34.

The multi-wired telephone cable 36 includes a first telephone cable conductor 50 connected to the first terminal 38, and a second telephone cable conductor 52 connected to the second terminal 38. Thus, the first telephone cable conductor 50 and the center conductor 46 allow for the coaxial cable 64 to electrically communicate through the telephone cable 36.

It is to be understood that the present invention is not limited to the embodiments described above, but encompasses any and all embodiments within the scope of the following claims.

I claim:

1. An adapter system comprising:

a wall-mounting adapter comprising:

a wallplate;

a first modular telephone jack attached to the wallplate;

a first coaxial cable connector attached to the wallplate; and at least one conductive wire electrically connecting the first modular telephone jack and the first coaxial connector;

a block adapter comprising:

a block;

a first and a second terminal disposed on the block;

a second modular telephone jack integrally connected to the block, the second modular jack having a first conductor electrically connected to the first terminal and a second conductor electrically connected to the second terminal; and a second coaxial cable connector attached to the block, the second coaxial cable connector having a frame and a center conductor, the center conductor electrically connected to the first terminal, the frame electrically connected to the second terminal; and a coaxial cable having a first end and a second end, the first end electrically connected to the first coaxial cable connector, the second end electrically connected to the second coaxial cable connector.

2. The adapter system according to claim 1, further comprising a telephone cable attached to the block, the telephone cable being electrically connected to the first terminal and the second terminal.

3. The adapter system according to claim 1, wherein the block adapter has a third terminal and a fourth terminal disposed on the block.

4. The adapter system according to claim 3, wherein the second modular telephone jack includes a third and a fourth conductor, said third conductor being electrically connected to the third terminal, said fourth conductor being electrically connected to the fourth terminal.

* * * * *